US007477864B2

(12) United States Patent
Daniels

(10) Patent No.: US 7,477,864 B2
(45) Date of Patent: Jan. 13, 2009

(54) METHODS FOR IMAGING PROCESS CARTRIDGE MODIFICATION

(75) Inventor: Matthew P. Daniels, Pittsboro, NC (US)

(73) Assignee: Static Control Components, Inc., Sanford, NC (US)

( * ) Notice: Subject to any disclaimer, the term of this patent is extended or adjusted under 35 U.S.C. 154(b) by 460 days.

(21) Appl. No.: 11/400,693

(22) Filed: Apr. 7, 2006

(65) Prior Publication Data

US 2007/0237543 A1 Oct. 11, 2007

(51) Int. Cl.
*G03G 15/00* (2006.01)

(52) U.S. Cl. ..... 399/109

(58) Field of Classification Search ..... 399/109, 399/107, 110, 111, 12
See application file for complete search history.

(56) References Cited

U.S. PATENT DOCUMENTS

| | | | | |
|---|---|---|---|---|
| 5,261,326 | A | 11/1993 | Michlin | |
| 5,729,795 | A | 3/1998 | Kavolius et al. | |
| 5,832,345 | A * | 11/1998 | Damji et al. | 399/111 |
| 5,911,096 | A * | 6/1999 | Batori et al. | 399/111 |
| 6,219,506 | B1 | 4/2001 | Morinaga et al. | |
| 6,654,577 | B1 | 11/2003 | Hooper | |
| 6,801,734 | B1 | 10/2004 | Jones et al. | |
| 6,904,248 | B2 | 6/2005 | Daniels | |
| 6,993,266 | B2 | 1/2006 | Daniels | |
| 7,054,577 | B2 * | 5/2006 | Rogers et al. | 399/109 |
| 7,068,963 | B2 * | 6/2006 | Moore et al. | 399/109 |
| 7,236,718 | B2 * | 6/2007 | Rogers et al. | 399/109 |
| 7,305,202 | B2 * | 12/2007 | Daniels | 399/109 |
| 2004/0170445 | A1 | 9/2004 | Moore et al. | |
| 2005/0036801 | A1 | 2/2005 | Burchette | |
| 2005/0135836 | A1 | 6/2005 | Rogers et al. | |
| 2008/0008495 | A1 * | 1/2008 | Martin et al. | 399/109 |

FOREIGN PATENT DOCUMENTS

GB 2 389 196 A 3/2003

OTHER PUBLICATIONS

Web Page: www.uninetimaging.com/newsletter/Volume6Issue7HP2550.htm Uninet News—vol. 6—Issue 7—HP 1500, 2500, 2550 Smartchip News, Apr. 8, 2005.

* cited by examiner

*Primary Examiner*—Susan S Lee

(57) ABSTRACT

Techniques are provided for modifying a printer cartridge and an imaging drum unit intended for installation in one type of printer to be installed in another type of printer or a plurality of printers. In one aspect, a method of modifying a toner cartridge may include modifying one or more end plate of the toner cartridge. In another aspect, a method of modifying a toner cartridge may include replacing one or more end plates of the toner cartridge with replacement end plates. In yet another aspect of the present invention, an imaging drum unit may include modifying one or more end plates of the imaging drum unit. In another aspect, an imaging drum unit may include replacing one or more end plates with replacement end plates.

15 Claims, 17 Drawing Sheets

METHODS FOR IMAGING PROCESS CARTRIDGE MODIFICATION

FIELD OF INVENTION

The present invention relates to remanufacturing and modifying imaging process cartridges, such as printer toner cartridges or imaging drum units, and more particularly to techniques for modifying an imaging process cartridge or imaging drum unit intended to operate in one type or model of imaging device, such as a printer, to operate in additional types or models of imaging devices.

BACKGROUND

Printer cartridges are typically designed to provide the consumer a certain number of print copies before the toner or ink is exhausted. The total number of prints varies depending on the type, quality and density of the print provided by the printer. After all of the toner or ink is spent, the cartridges are either thrown away or recycled.

An emerging industry has developed that deals with the recycling of printer cartridges. Typically, the cartridge is recycled by a cartridge remanufacturer, who receives spent printer cartridges and refurbishes them. The refurbishment process entails replacing the worn or nonfunctioning parts, refilling the cartridge with either toner or ink, and distributing the refurbished cartridges into the marketplace.

Toner cartridges are typically designed to fit into one type of laser printer or family of laser printers. For example, the same toner cartridge may be used in an HP4200 or HP4300 monochrome laser printer. As new printer models are introduced, the printer manufacturer may decide to alter the physical characteristics of the printer cartridge. In some cases the alteration may be an entirely new shape or the printer manufacturer may only change a minor detail such as an indentation or a protrusion on the cartridge.

Additionally, different toner cartridges may be used within the same printer. These toner cartridges may have very similar physical characteristics. For example, in the HP2500 color laser printer, there are four separate toner cartridges containing black and colored toner (magenta, cyan, and yellow). The physical differences between the toner cartridges for the HP2500 color laser printer are relatively minor. The HP2500 cartridge manufacturer has installed a protrusion in a unique location on one of the ends of each toner cartridge to distinguish each toner cartridge from one another. The protrusion mates with a corresponding recess in the printer's toner cartridge space. When the cartridge is inserted into the printer, the protrusion aligns with the recess allowing only the designated cartridge to be installed.

A typical toner cartridge comprises an assembled plastic housing. The material of the housing may be molded plastic or other plastic composite. During the remanufacturing of the cartridge, the cartridge is disassembled, cleaned, refurbished and reassembled. The last step of the refurbishment process includes refilling the cartridge with toner and the cartridge is repackaged. As part of the refurbishment process, the toner cartridges may be modified in order to remove any restriction regarding usage.

Additionally, some printers separate the toner storage function from the image transfer function. In these printers, toner is stored in the toner cartridge and an imaging drum unit performs the imaging function. In some printers, the imaging drum unit may be a field replaceable unit. Typically within the imaging drum unit is the OPC (Organic Photo Conductor) drum as well as the various image transfer components. The imaging drum unit may also have certain physical characteristics unique to a particular printer model type or family. For example, the imaging drum unit for the HP2500 and HP2550 may be identical except for a protrusion or recess located on the endplates of the unit.

The present invention is intended for use in removing a protrusion on an end plate of a toner cartridge to allow the modified toner cartridge to be used in different locations within the same printer or other printers. Another embodiment of the present invention is designed to alter the physical characteristics of an imaging drum unit to allow the modified imaging drum unit to be used in other printers.

SUMMARY

A method of modifying an imaging process cartridge, the imaging process cartridge sized to be installed in a first location in a first type of color imaging device and not sized to be installed in either a second location in said first color imaging device or a second type of color imaging device, the method comprising: providing the imaging process cartridge said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, removing said protrusion from said external surface, said imaging process cartridge now usable in either a second location within said first color imaging device or said second color imaging device.

A method of modifying an imaging process cartridge, the imaging process cartridge sized to be installed in a first location in a first type of color imaging device and not sized to be installed in either a second location in said first color imaging device or a second type of color imaging device, the method comprising: providing the imaging process cartridge, said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, separating said gear side faceplate from said imaging process cartridge, removing said protrusion from said external surface, reattaching said gear side faceplate to said imaging process cartridge, said imaging process cartridge now usable in either a second location within said first color imaging device or said second color imaging device.

A method of modifying an imaging process cartridge, the imaging process cartridge sized to be installed in a first location in a first type of color imaging device and not sized to be installed in either a second location in said first color imaging device or a second type of color imaging device, the method comprising: providing the imaging process cartridge said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, separating said gear side faceplate from said imaging process cartridge, attaching a new gear side faceplate to said imaging process cartridge, said new gear side faceplate not having a protrusion, said imaging process cartridge now usable in either a second location within said first color imaging device or said second color imaging device.

A more complete understanding of the present invention, as well as further features and advantages of the invention, will be apparent from the following detailed description and the accompanying drawings.

DETAILED DESCRIPTION

Figure 1:
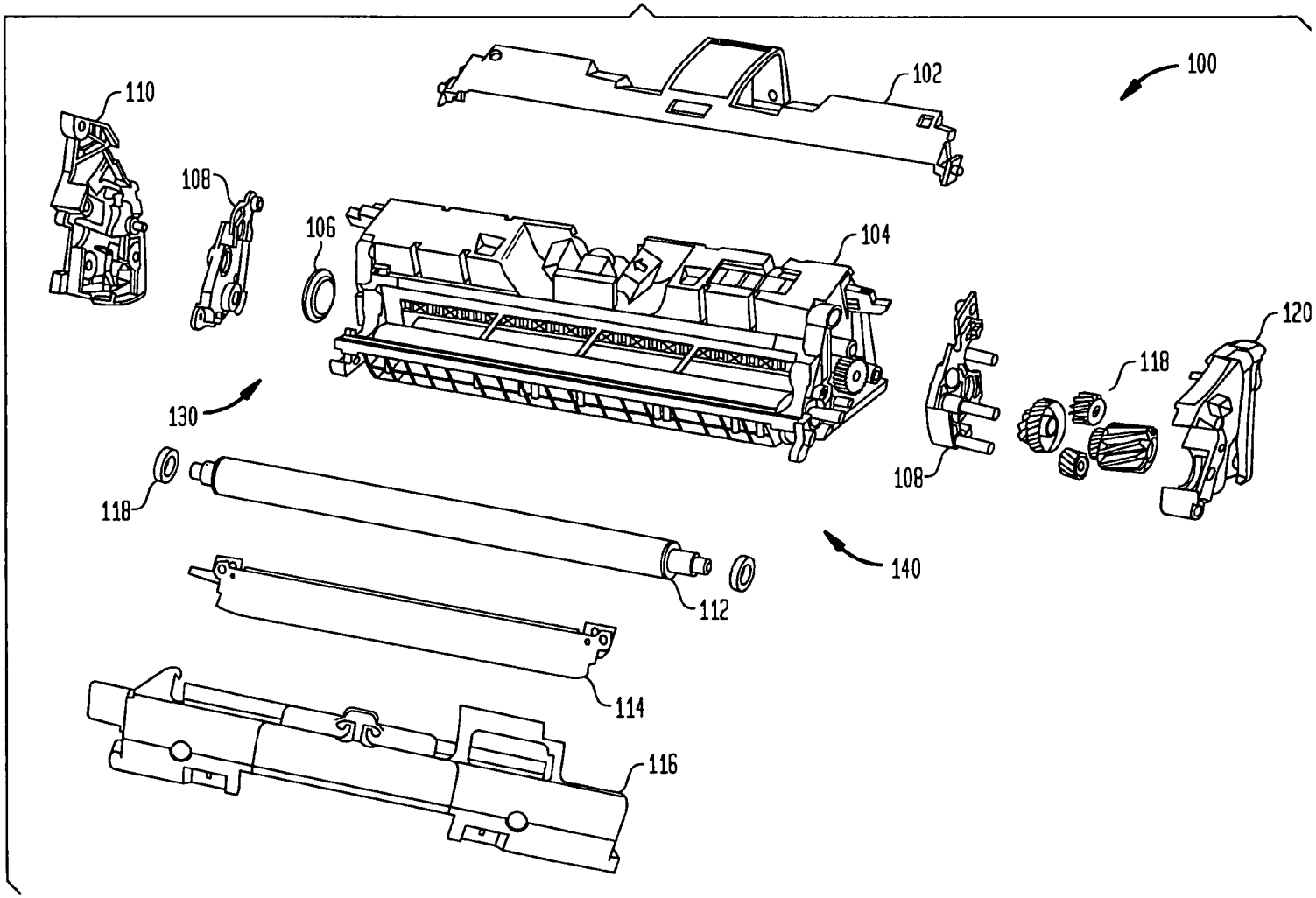
FIG. 1 (PRIOR ART)
FIG. 1 shows a front perspective exploded view of a prior art black HP2500 toner cartridge.

The following detailed description of preferred embodiments refers to the accompanying drawings, which illustrate specific embodiments of the invention. In the discussion that follows, specific systems and techniques for repairing, manufacturing or remanufacturing an imaging cartridge, such as a toner cartridge. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Within the printer industry, printer manufacturers have employed various techniques to differentiate between toner cartridges or imaging drum units used in different printers. These techniques range from the obvious altering of the physical dimensions and shape of the toner cartridge or imaging drum unit to very subtle indentations or protrusions positioned at certain locations on the toner cartridge or imaging drum unit. For example, some printer manufacturers have installed protrusions such as fins or keys that extend out from the printer's toner cartridge compartment and are positioned inside a recess on the toner cartridge when the toner cartridge is installed inside the printer. In other printer types this arrangement may be reversed. The key may exist on the toner cartridge, and the recess may exist inside the toner cartridge compartment inside the printer.

In color laser printers, multiple toner cartridges are typically installed. These printers have separate toner cartridges for black, cyan, magenta and yellow toner. As is the case with the HP2500, the toner cartridges may be physically identical except for a key on the toner cartridge. The printer manufacturer typically provides the key to restrict the wrong toner cartridge from being installed in a particular toner cartridge location. In the HP2500 color laser printer for example, the key on a black toner cartridge restricts a black toner cartridge from being inserted into the location for a cyan toner cartridge.

Additionally, in color laser printers, two separate units may perform the toner storage and image transfer function. In these printers, a separate toner cartridge and imaging drum unit work together during the printing process. The toner cartridge acts only as a storage device, transferring toner to the imaging drum unit. The imaging drum unit transfers the toner from the various toner cartridges and fuses the toner to the print media. In some printers, the imaging drum unit may be removed and replaced as a unit. Printer manufacturers may extend the same keying concept to the imaging drum units, differentiating between imaging drum units of different printer types.

As new printer models are developed, "new" toner cartridges or imaging drum units may also be introduced. In some cases, the new toner cartridge or imaging drum unit may contain exactly the same components as those of the previous printer model. However, the new toner cartridge or imaging drum unit may have slightly different physical packaging. In some cases, the printer manufacturer may install different keys, or keys in different locations. Changing the size, shape, orientation or location of the keys allows the printer manufacturer to differentiate between a previously introduced toner cartridges or imaging drum units and those of newer models. This may allow the printer manufacturer to increase his margins by charging the consumer a premium for the new cartridge or imaging drum unit.

Printer manufacturers may take advantage of existing toner cartridge technology by using an existing toner cartridge or imaging drum unit design and making only slight physical packaging modifications. For example, the black toner cartridge for the HP2500 color laser printer may have exactly the same internal components and even use the same toner as the black toner cartridge for the HP2550 color laser printer. In this case, the only packaging difference between the two cartridges is the size, shape, location and number of keys on the toner cartridge.

Similarly, the imaging drum unit of the HP2550 color laser printer has only slightly different physical packaging characteristics when compared to the imaging drum unit for the HP2500 color laser printer. These details are described in greater detail in subsequent sections.

In the toner cartridge refurbishment industry, the used toner cartridges and imaging drum units are collected and serviced by toner cartridge remanufacturers. The first step in the refurbishment process is the disassembling of the spent devices. Next, the internal components are separated. Non-functioning components are replaced, and the remaining components, as well as the body of the device undergo a cleaning process. In the final step the device is reassembled and new toner is added to the toner cartridge. The refurbished device is then packaged and distributed to the consumer.

Part of the refurbishment process may include making physical alterations to the toner cartridge or imaging drum unit. For example, older cartridges or imaging drum units may be altered or converted into other compatible device types. Alternatively, the remanufacturer may remove all of the keys on a device, thus creating a "universal" cartridge that may be used in all locations within a printer or across multiple printers. The present invention provides a way of converting a printer toner cartridge of one type into another.

FIG. 1 shows an exploded view of a prior art HP2500 black toner cartridge 100. The cartridge 100 comprises a latch cover 102, which is attached to a toner hopper 104. A hopper cap 106 is affixed to the toner hopper 104 on the contact side 130 of toner cartridge 100. Opposite the contact side 130 of the toner cartridge 100 is a gear side 140. Attached to the toner hopper 104 on the contact side 130 is a support plate 108 and a contact side end plate 110. On the gear side 140 of the toner hopper 104 is attached a support plate 108, gears 118 and a gear side end plate 120. A developer roller 112 rests in the toner hopper 104 extending from the contact side 130 to the gear side 140. Installed on top of the developer roller 112 is a doctor blade 114. Protecting the doctor blade 114 and developer roller 112 is a shipping protector 116.

Figure 2A:
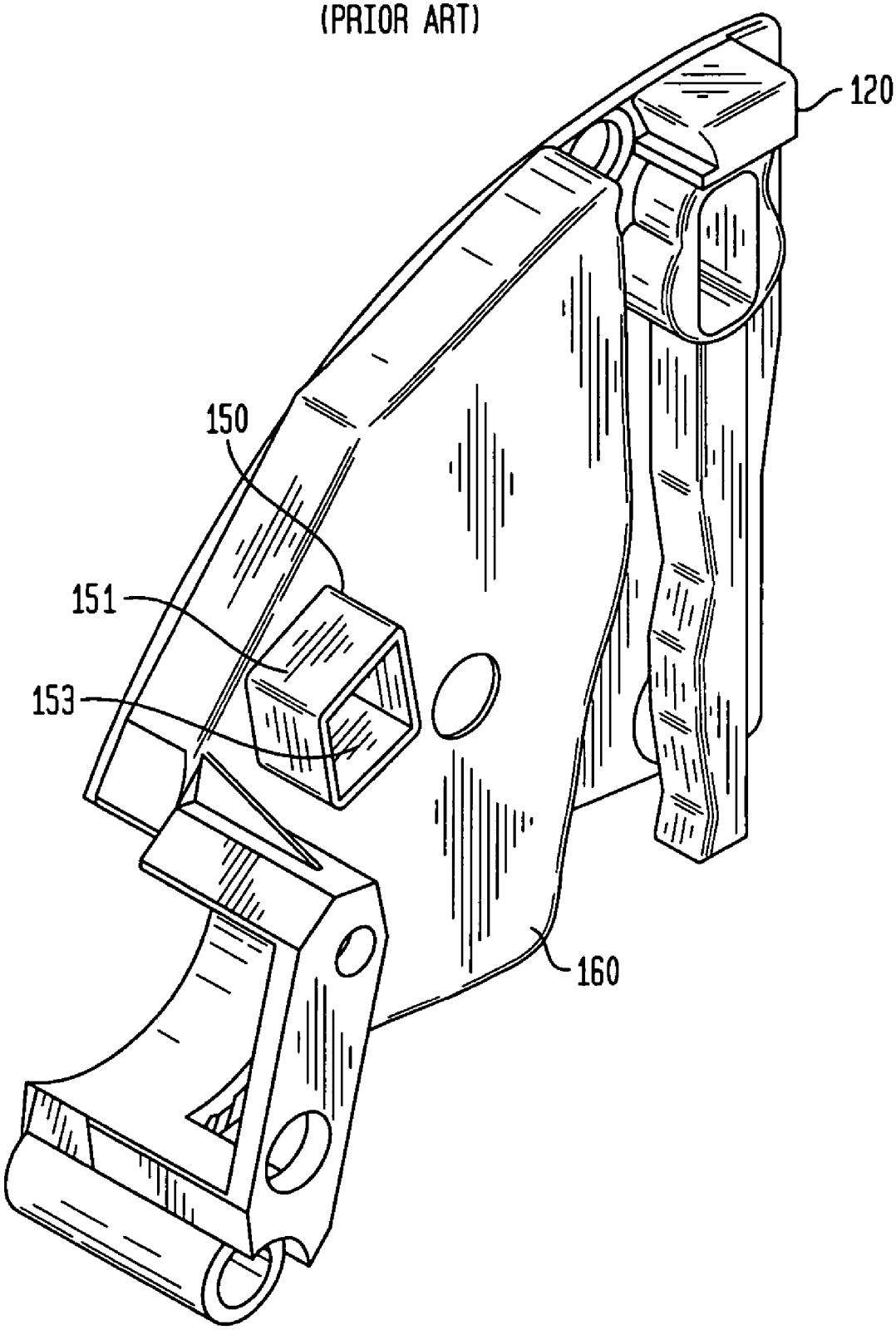
FIG. 2A (PRIOR ART)
FIG. 2A shows a side perspective view of a gear side end plate the cartridge of FIG. 1.

FIG. 2A displays a side perspective view of the gear side end plate 120 of toner cartridge 100. Located on the gear side end plate 120 is a key 150, which extends perpendicularly away from an exterior surface 160 of the gear side end plate 120. When the cartridge is fully assembled, the key is roughly parallel to the developer roller 112. The key 150 aligns with a recess (not shown) located within the black toner cartridge compartment inside the HP2500 color laser printer. As shown in FIG. 2A, the key 150 is generally square and hollow in shape. The key also has an internal wall 153 and an external wall 151. The key 150 prevents the black toner cartridge 100 from being inserted into the cyan, magenta, or yellow toner cartridge location within the printer.

Figure 2B:
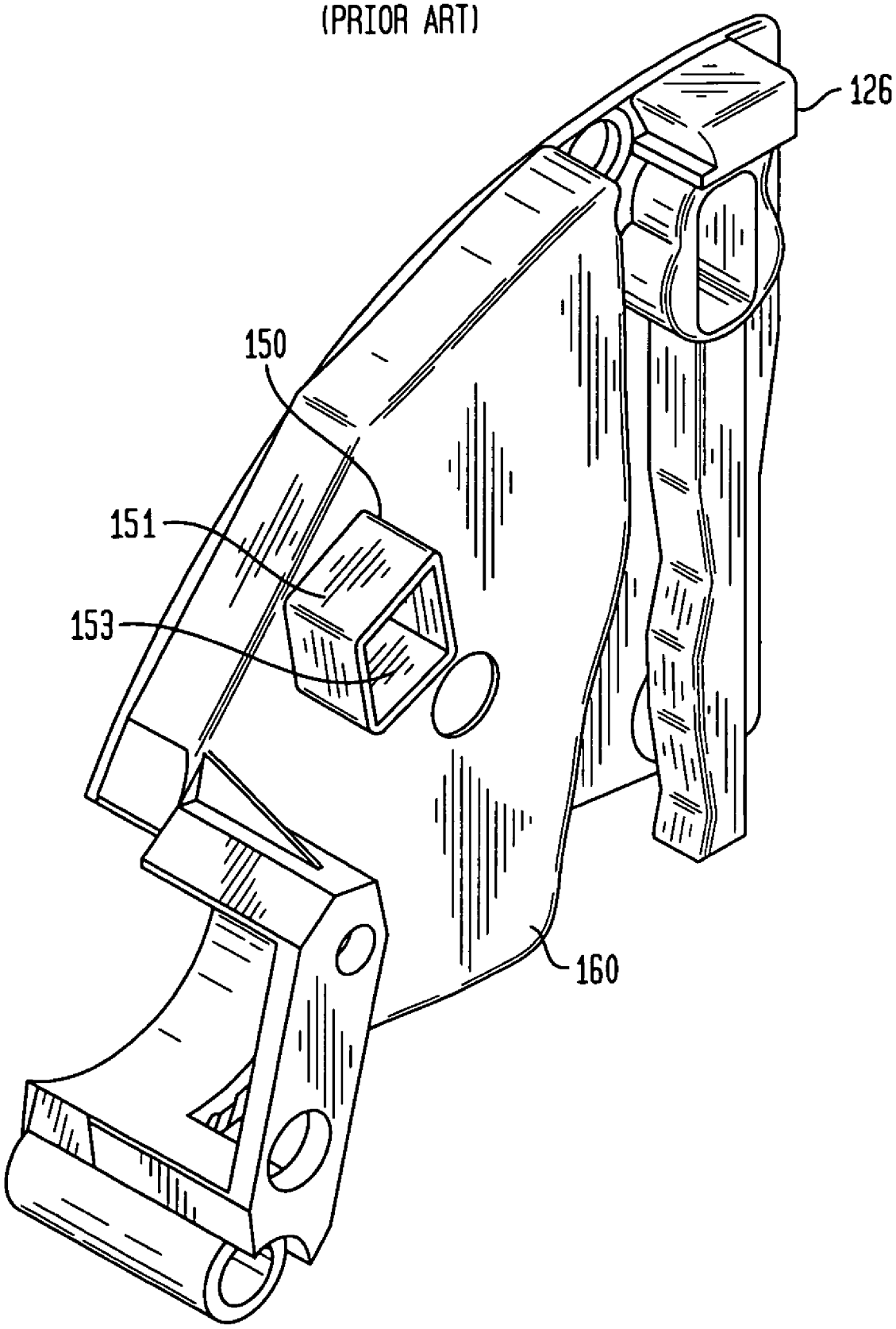
FIG. 2B (PRIOR ART)
FIG. 2B shows a side perspective view of a prior art gear side end plate of the cyan toner cartridge of the HP2500 color laser printer.
Figure 2C:
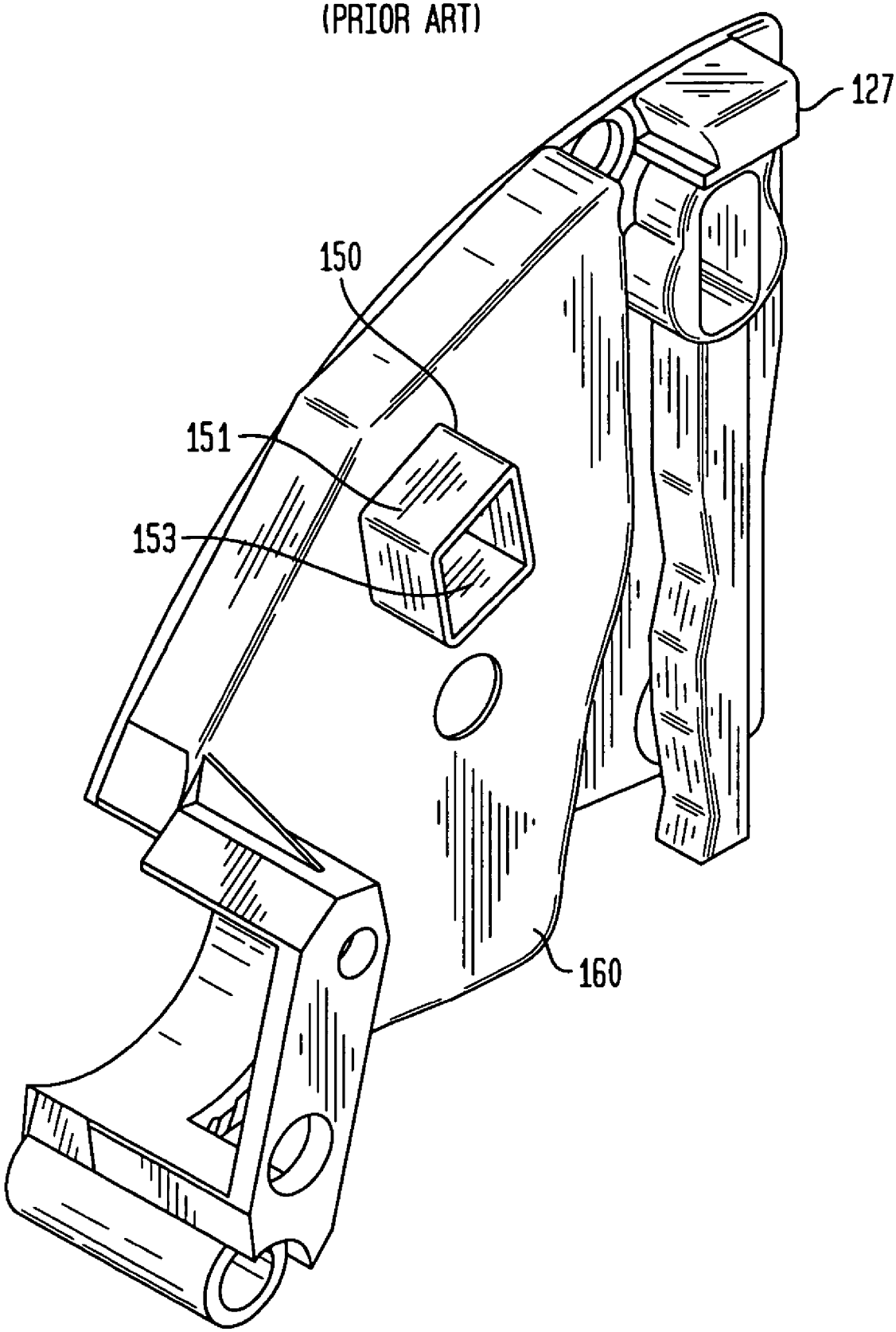
FIG. 2C (PRIOR ART)
FIG. 2C shows a side perspective view of a prior art gear side end plate of the magenta toner cartridge of the HP2500 color laser printer.
Figure 2D:
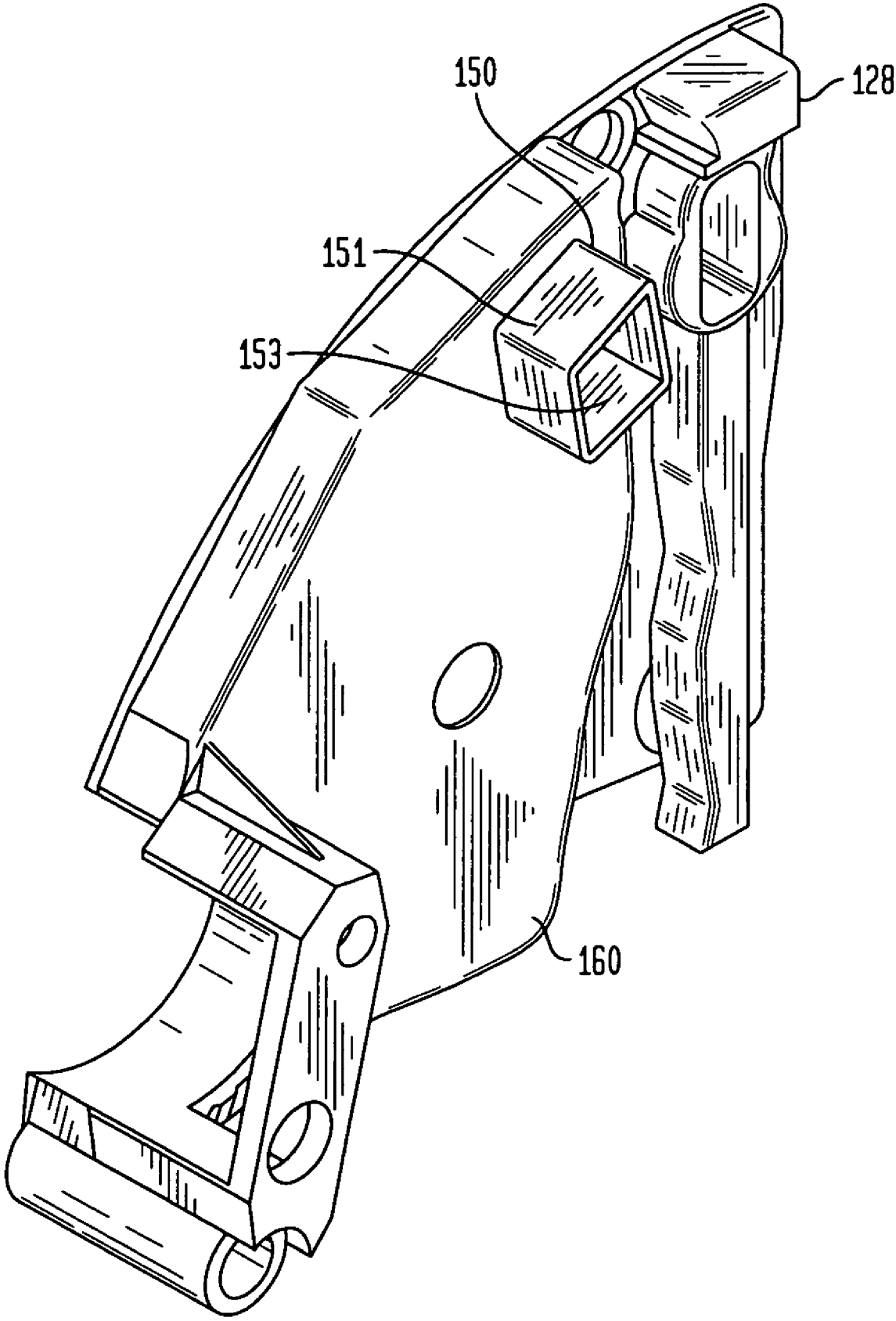
FIG. 2D shows a side perspective view of a prior art gear side end plate of the yellow toner cartridge of the HP2500 color laser printer.

FIG. 2B displays a gear side end plate 126 for the cyan toner cartridge used in the HP2500 color laser printer. FIGS. 2C and 2D display the gear side end plates 127, 128 for the magenta and yellow toner cartridges respectively. The keys 150 for these cartridges 126, 127, 128 are roughly the same shape, have an internal wall 153 and an external wall 151, but are positioned at a different location on the gear side end plates. For ease of illustration, the present invention is described as it relates to the black toner cartridge 100. The present invention may be applied to any of the aforementioned toner cartridges.

In one embodiment of the present invention, the key 150 is removed from the gear side end plate 120 of toner cartridge 100. This may be performed before the toner cartridge 100 is disassembled. Toner cartridge 100 may be inserted and secured in a conversion jig (not shown). After the toner cartridge 100 is secured into place, a RotoZip™ tool may be used to remove the key 150. Alternatively, a Dremmel™ tool or other type of cutting instrument may be used instead of the Rotozip tool. In another embodiment of the present invention, the key 150 may be removed with a pair of snips or cutters. After the key 150 has been removed, a file or other type of instrument may be used to smooth out any rough edges where the key 150 was formally located.

Figure 2E:
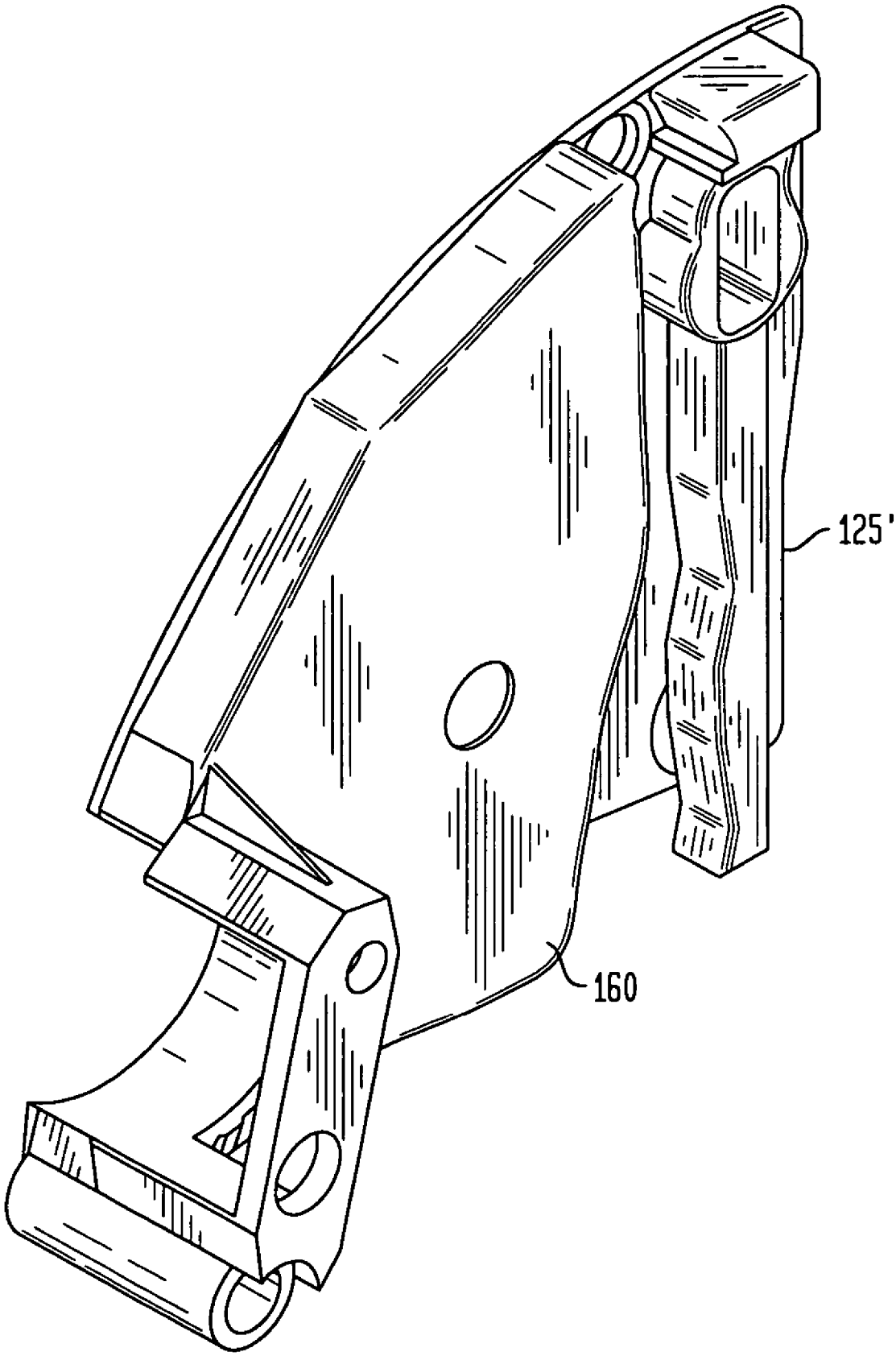
FIG. 2E shows a side perspective view of a gear side end plate in accordance with one embodiment of the present invention.

FIG. 2E shows a converted gear side endplate 125 with the key 150 removed. Once the key 150 has been removed, the toner cartridge 100 may then continue through the refurbishment process. At the end of the refurbishment process, after replacing any worn or defective components, the toner cartridge 100 may be filled with any color toner. With the restriction of the key 150 removed, the cartridge 100 may fit into any of the toner cartridge locations within the HP2500 color laser printer.

Figure 3A:
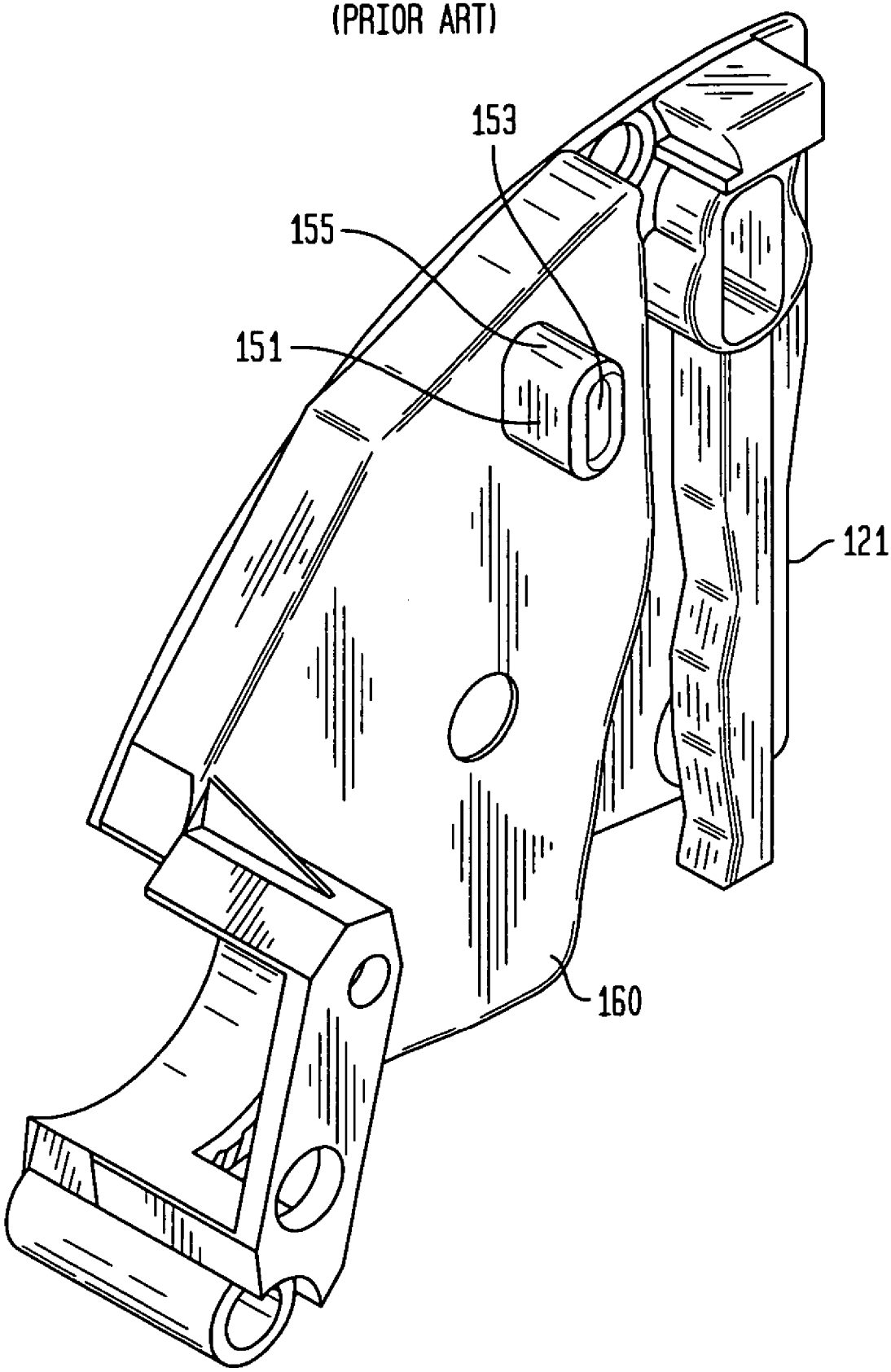
FIG. 3A (PRIOR ART)
FIG. 3A shows a side perspective view of a prior art gear side end plate of a black toner cartridge for use in the HP 2550 color laser printer.
Figure 3B:
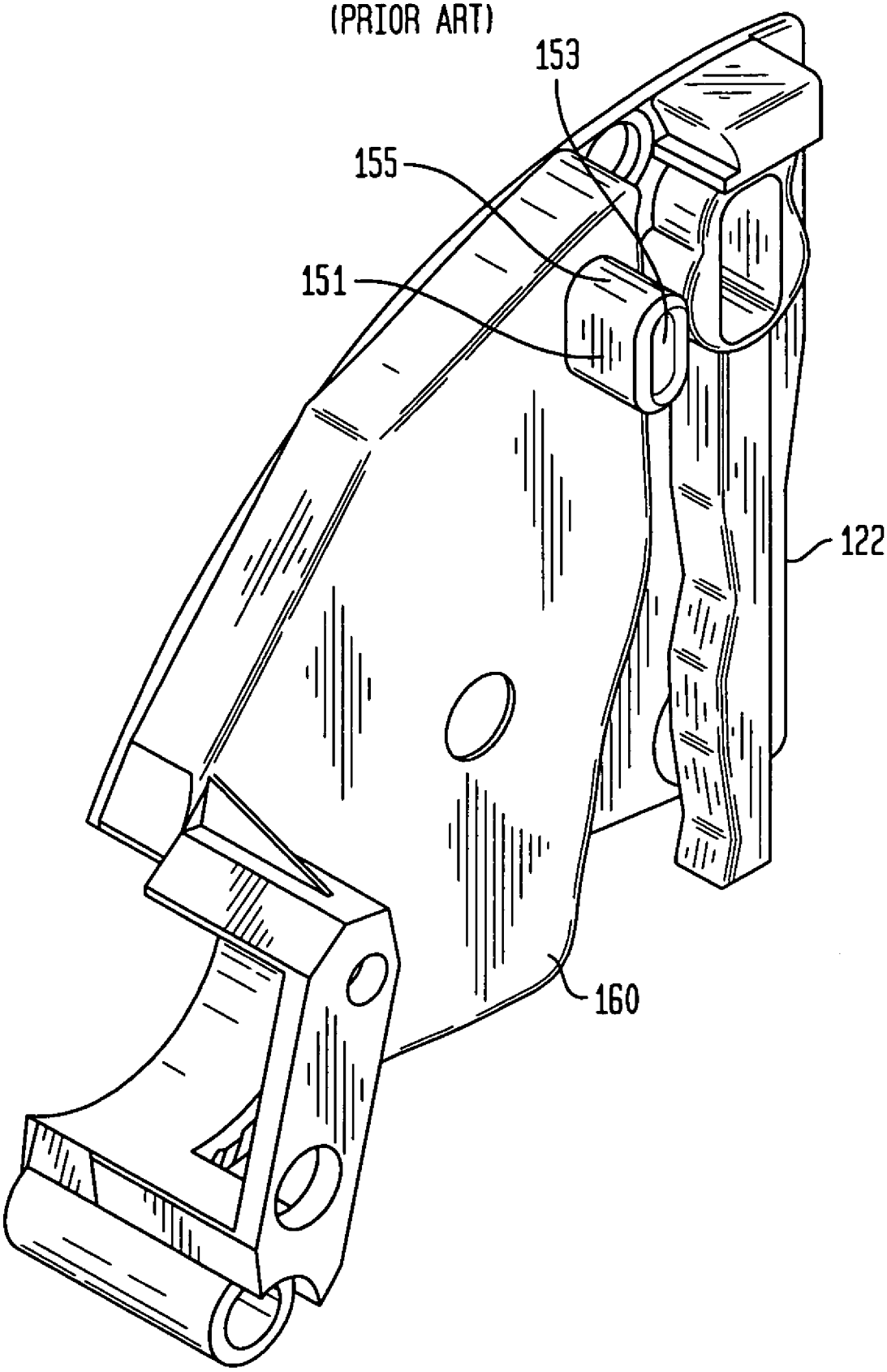
FIG. 3B (PRIOR ART)
FIG. 3B shows a side perspective view of a prior art gear side end plate of a cyan toner cartridge for use in the HP 2550 color laser printer.
Figure 3C:
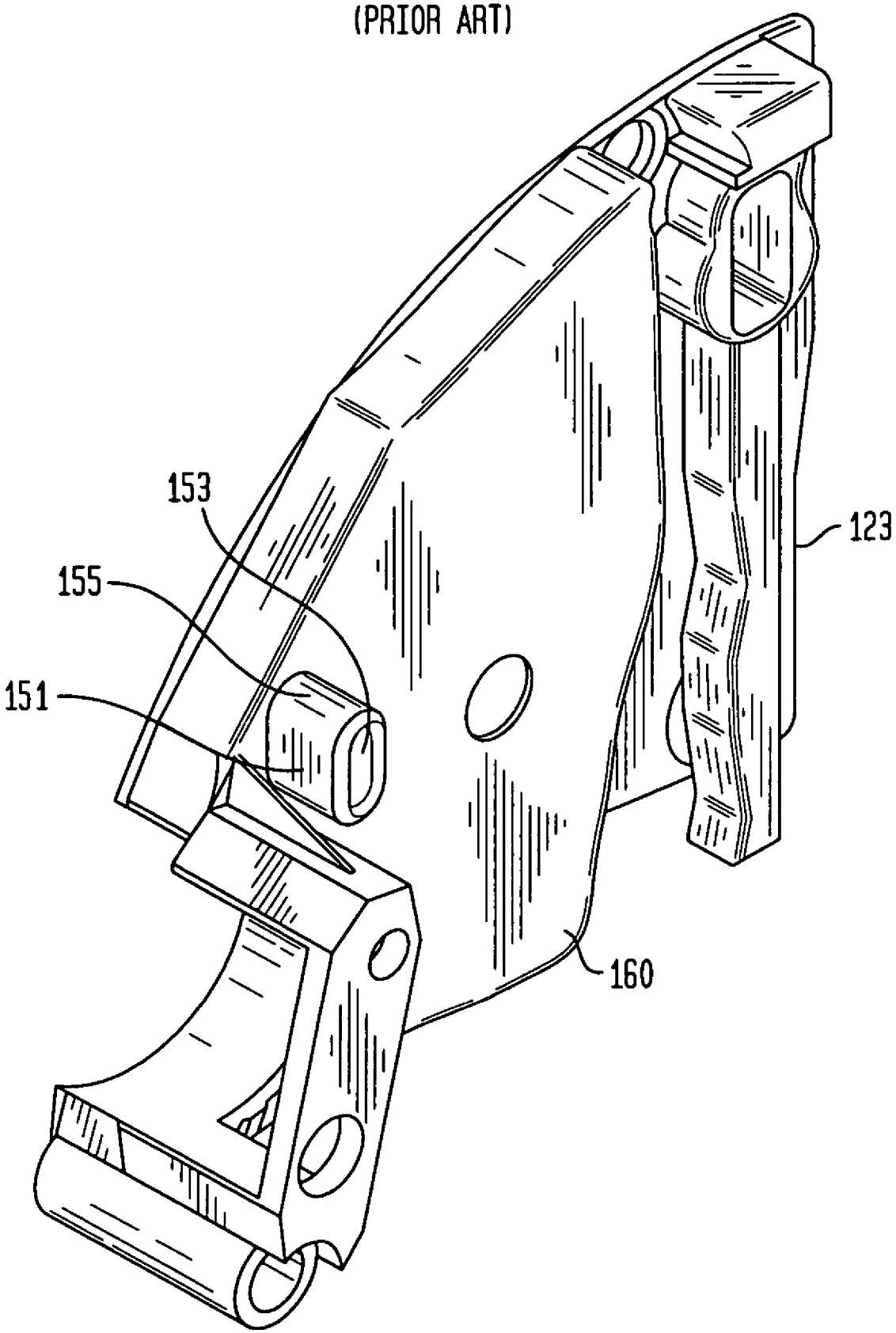
FIG. 3C (PRIOR ART)
FIG. 3C shows a side perspective view of a prior art gear side end plate of a magenta toner cartridge for use in the HP 2550 color laser printer.
Figure 3D:
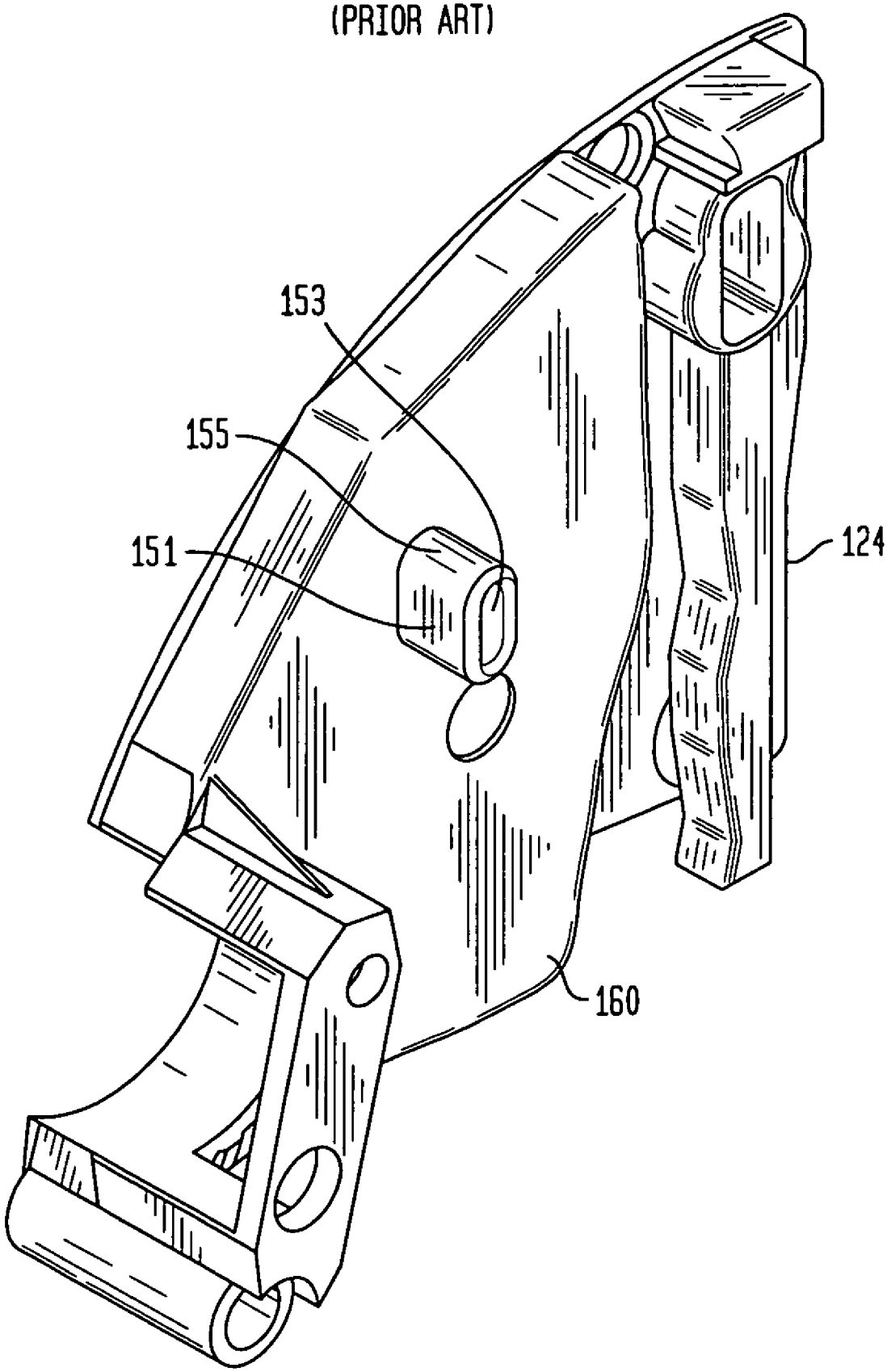
FIG. 3D (PRIOR ART)
FIG. 3D shows a side perspective view of a prior art gear side end plate of a yellow toner cartridge for use in the HP 2550 color laser printer.

FIG. 3A displays a gear side end plate 121 used on a black toner cartridge for the HP2550 color laser printer. The gear side end plate 121 has a generally elliptical key 155. FIG. 3B displays a prior art gear side end plate 122 for the cyan toner cartridge used in the HP2550 color laser printer. FIGS. 3C and 3D display the gear side end plates 123, 124 of a prior art magenta and yellow toner cartridges used in the HP2550 color laser printer. As can be seen by comparing FIGS. 3A-3D, the key 155 differs only in location. The key 155 is similar in shape and has an external wall 151 and an internal wall 153 similar to key 150. As is the case with the HP2500, the location of the key 155 determines which color toner is installed in the toner cartridge for the HP2550 color laser printer.

In another embodiment of the present invention, key 155 may be removed using any of the previously described techniques. After key 155 is removed, the resulting gear side end plate resembles the gear side end plate 125 as shown in FIG. 2E.

Figure 4A:
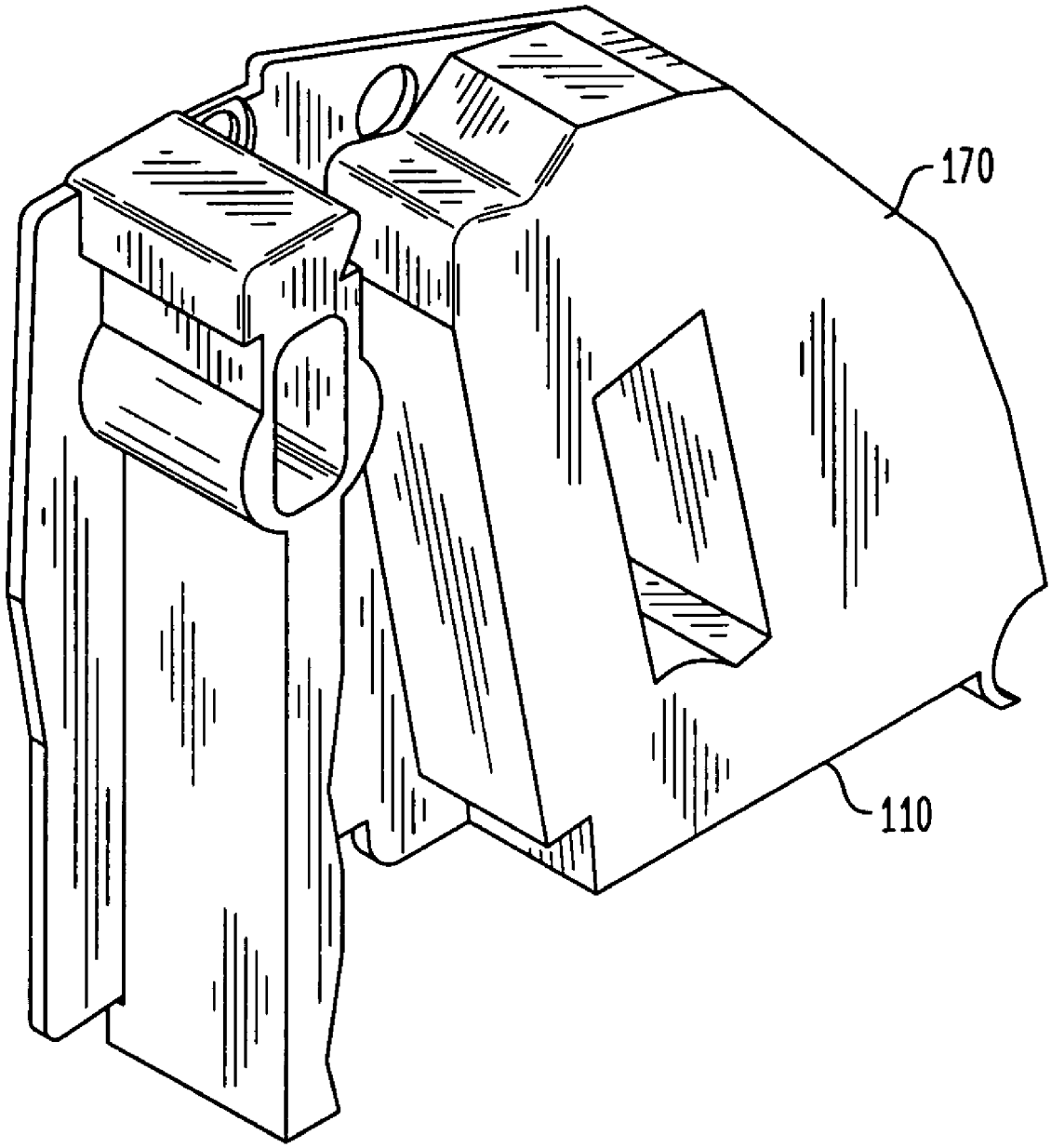
FIG. 4A shows a side perspective view of a contact side end plate of a prior art black toner cartridge for use in the HP2550 color laser printer.
Figure 4B:
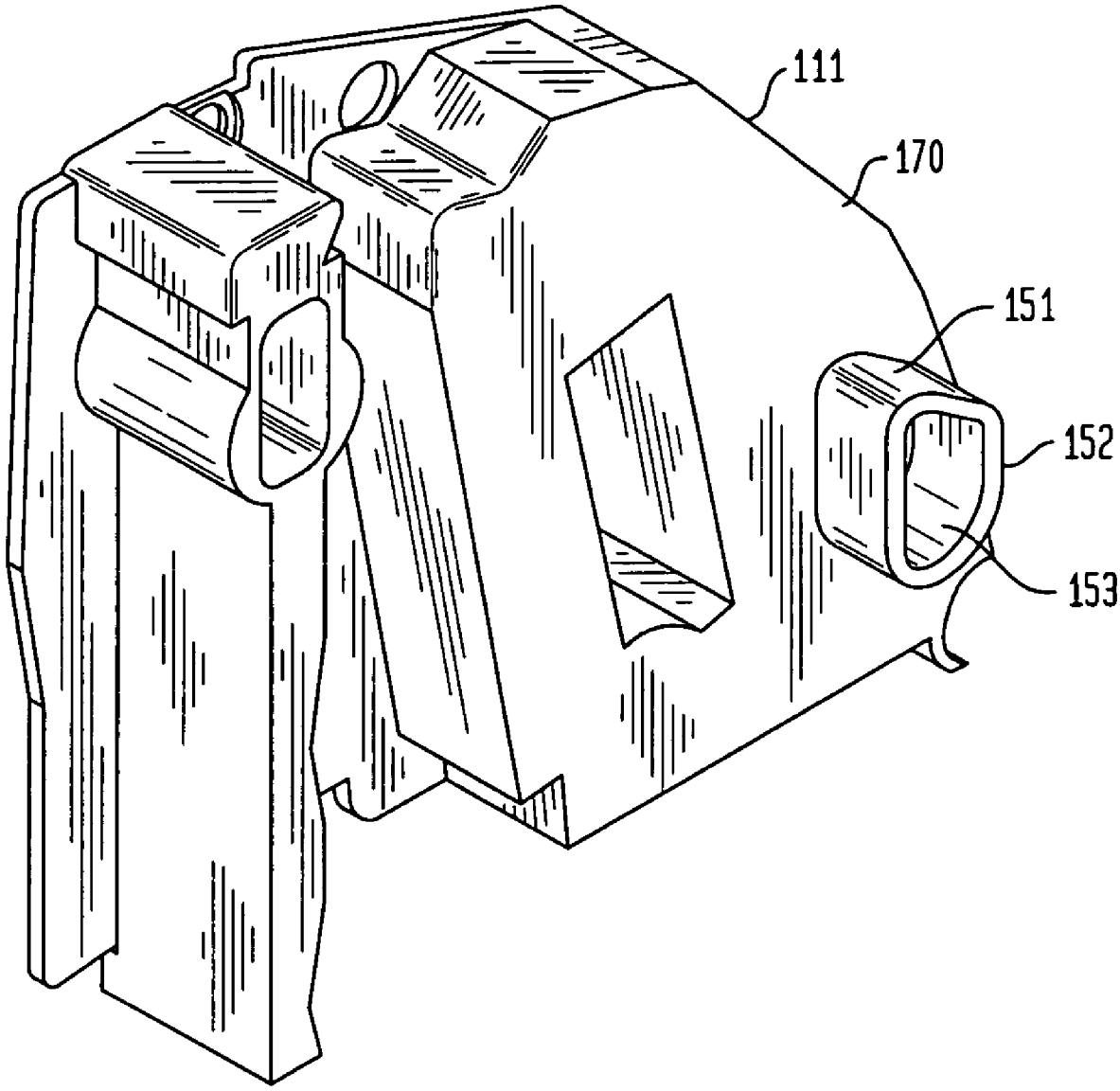
FIG. 4B (PRIOR ART)
FIG. 4B shows a side perspective view of a contact side end plate in accordance with one embodiment of the present invention.

FIG. 4A displays a contact side end plate 110 of toner cartridge 100. As shown in FIG. 4A, the contact side end plate 110 comprises no keys. FIG. 4B displays a contact side end plate 111 for an HP2550 black toner cartridge. As can be seen in FIG. 4B, a key 152 extends perpendicularly away from an external surface 170 of contact side end plate 111. Key 152 has an internal wall 153 and an external wall 151. The other toner cartridges (cyan, magenta and yellow) for the HP2550 color laser printer have the same key 152 in the same location on their respective contact side end plates. When converting an HP2550 black toner cartridge to one for use in any of the other toner locations within the HP2550 color laser printer, only key 155 needs to be removed. If any of the cartridges for the HP2550 are to be converted for use in the HP2500 color laser printer, both keys 152 and 155 need to be removed. The same removal process as described above may be used to remove the key 152.

In an alternative embodiment of the present invention, the gear side end plate 120 or the contact side end plate 110 may be replaced with a preformed replacement part that does not have any keying features. The replacement part may be a gear side end plate 120 or contact side end plate 110 that has undergone the conversion process as outlined herein. Alternatively, the replacement part may be a prefabricated gear side end plate 120 or contact side end plate 110 manufactured without the keying features previously described.

Figure 5:
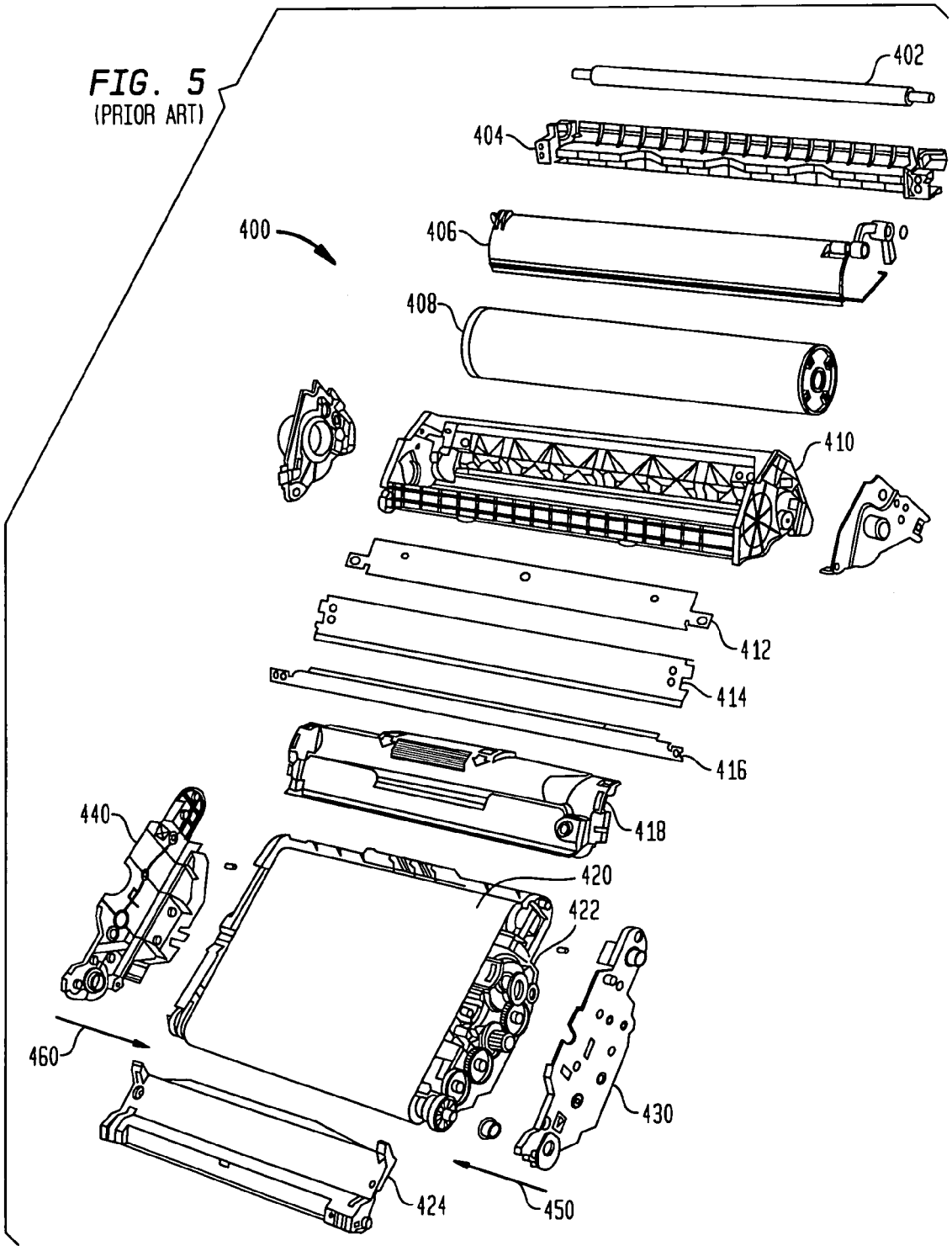
FIG. 5 (PRIOR ART)
FIG. 5 shows an exploded side perspective view of an imaging drum unit for use in the HP2500 printer.

FIG. 5 displays an exploded front perspective view of a prior art HP2500 imaging drum unit 400. The imaging drum unit 400 comprises a PCR 402 (Primary Charge Roller) installed in the PCR housing 404. Located next to the PCR is the OPC (Organic Photo Conductor) drum 408. Covering the OPC drum 408 is the drum shutter 406. The OPC drum 408 is housed in the OPC assembly 410. Touching the OPC drum 408 is the wiper blade 414 supported by the support blade 412. Mounted on top of the wiper blade 414 is the recovery blade 416. Covering the blades (412, 414 and 416) is a handle 418. Below the handle is the transfer belt 420 which is installed on the waste drive assembly 422. On the end of the transfer belt 420 is the belt cleaning assembly 424. The imaging drum unit 400 does not contain any structure such as a toner hopper 104 (FIG. 1), since it is receiving toner paced on the transfer belt 420, the toner cartridge 100.

The gears 424 of the waste drive assembly 422 are located on a gear side 450 of the imaging drum unit 400. Also on the gear side 450 of the waste drive assembly 422 is a gear side end plate 430. Opposite the gear side 450, on a drive side 460, is a drive side end plate 440.

During the printing process, the PCR 402 provides a uniform charge to the transfer belt 420 and consequently to the OPC drum 408. As the image is transferred to the OPC drum 408, the laser of the printer alters the charge on the OPC drum 408 to correspond with the image. The charged OPC drum 408 then picks up the appropriate amount of toner from the appropriate toner cartridge 100 corresponding to the image. The toner is then transferred from the OPC drum 408 to the transfer belt 420, which is in turn transferred and fused to the print media. The belt cleaning assembly 424 removes any excess toner remaining on the transfer belt 420. Similarly, the wiper blade 414 removes any excess toner remaining on the OPC drum 408.

As stated previously, printer manufacturers may reuse many of the same components and technology as they migrate from one printer model to the next. For example, the imaging drum unit 400 may contain many of the same components as the imaging drum unit for the HP2550. Additionally, the imaging drum unit 400 may be physically identical to the imaging drum unit for the HP2550 with the exception of a recess or protrusion on the end plates (450, 460).

Figure 6A:
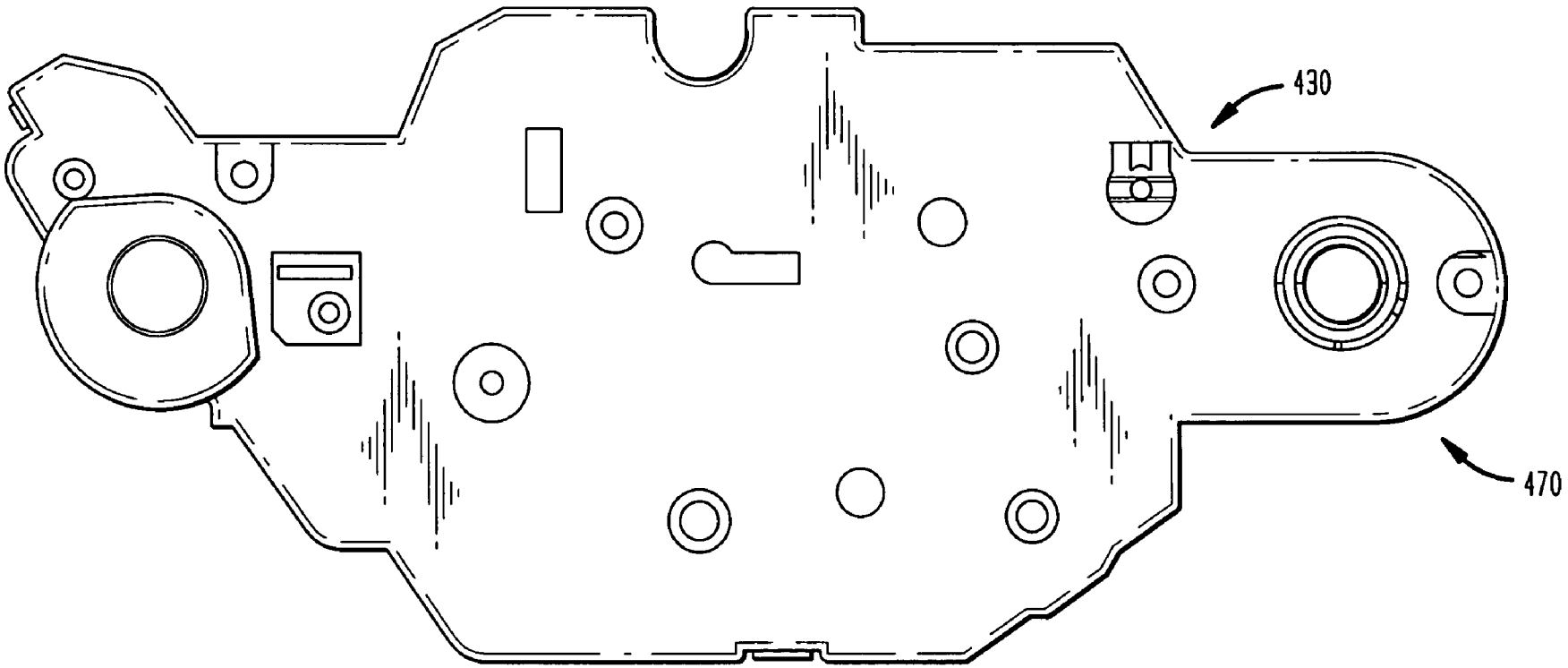
FIG. 6A shows a front view of a gear side end plate of waste drive assembly for the imaging drum unit of FIG. 4.
Figure 6B:
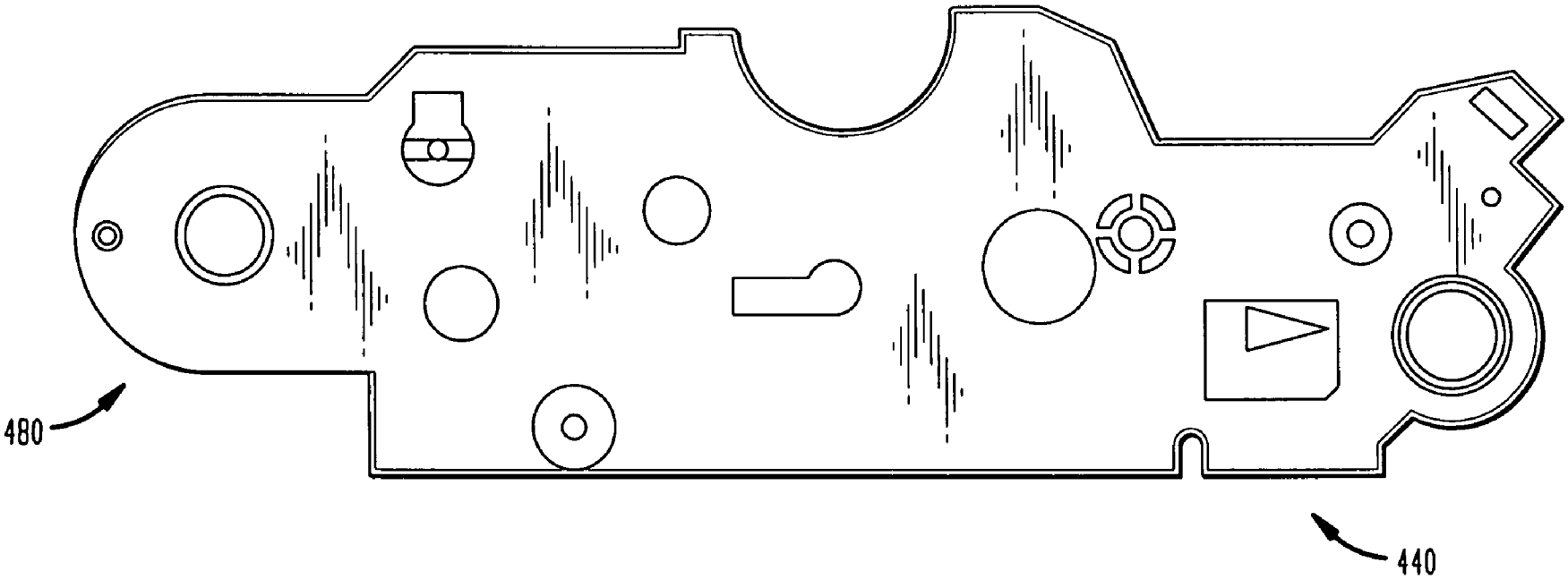
FIG. 6B shows a front view of a drive side end plate of waste drive assembly for the imaging drum unit of FIG. 4.
Figure 7A:
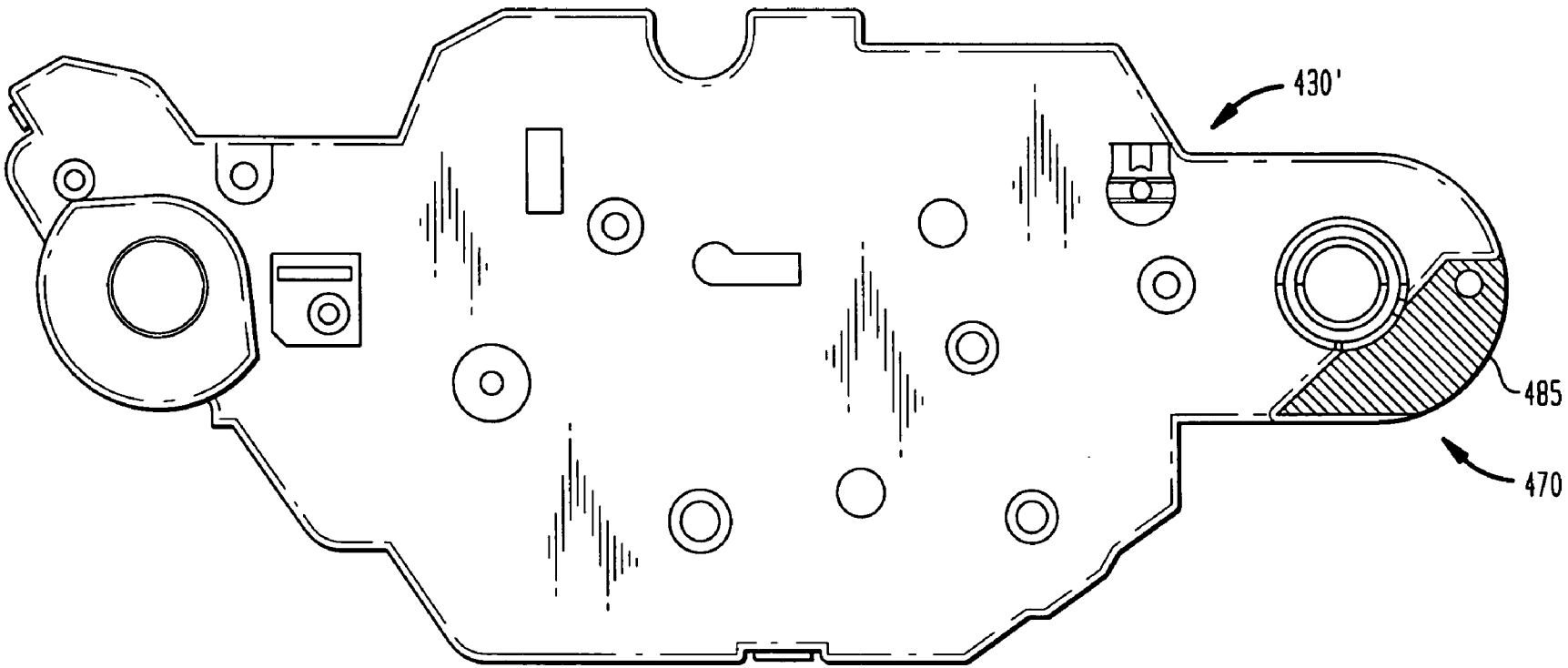
FIG. 7A shows a front view of a gear side end plate of waste drive assembly for an imaging drum unit of an HP2550 color laser printer.
Figure 7B:
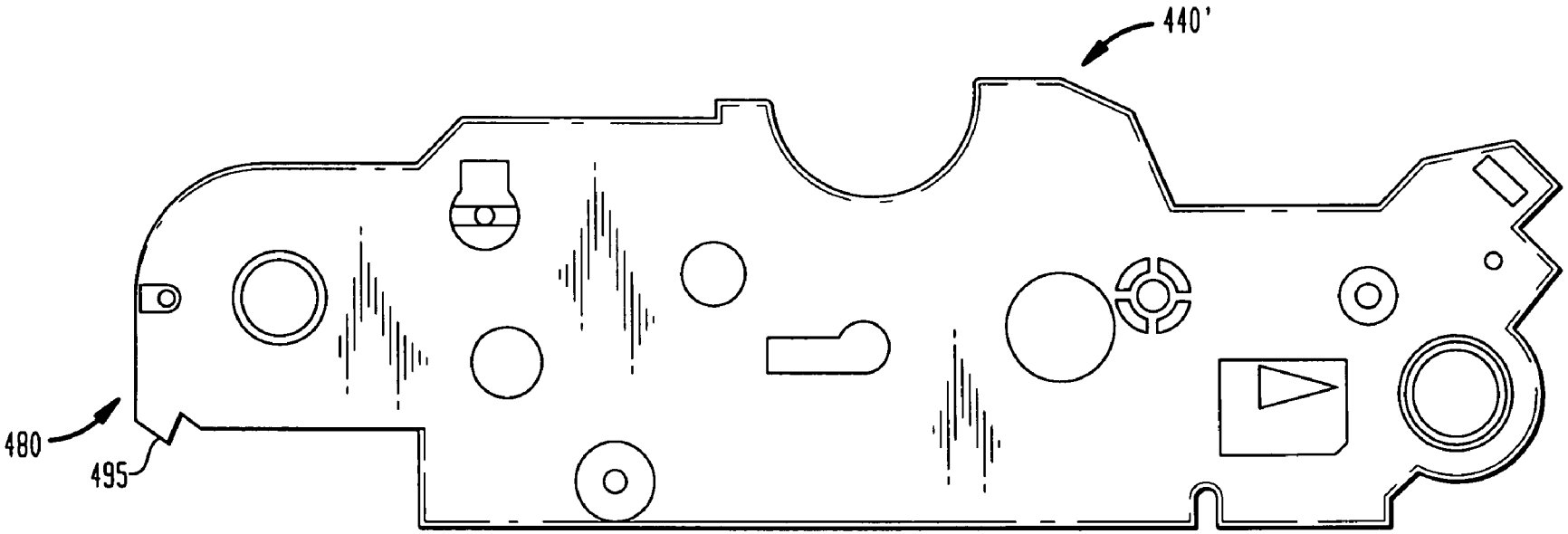
FIG. 7B shows a front view of a drive side end plate of waste drive assembly for an imaging drum unit of an HP2550 color laser printer.

FIG. 6A shows front view of the gear side end plate 430 and FIG. 6B shows the drive side end plate 440 of an imaging drum unit 400 for the HP2500 color laser printer. FIG. 7A shows a gear side end plate 430' and FIG. 7B shows a drive side end plate 440' present on an imaging drum unit used in the HP2550 color laser printer. As shown in FIG. 7A, a recess 485 exists on the right end 470 of the gear side end plate 430'. The recess 485 mates with a protrusion inside the imaging drum unit compartment within the printer, when the imaging drum unit is inserted into the printer. Similarly the drive side end plate 440' comprises a fin 495 located on a left side 480 which mates with a corresponding recess located inside the imaging drum unit compartment within the printer.

Thus, the imaging drum unit 400 for the HP2500 color laser printer will not fit into the HP2550 color laser printer because the gear side end plate 430 does not have a recess 485. Similarly, the imaging drum unit for the HP2550 color laser printer will not fit into the HP2500 color laser printer due to the presence of fin 495. The present invention eliminates this restriction.

During the refurbishment and remanufacturing process, the recess 485 may be added to the gear side end plate 430 (FIG. 6A) of the imaging drum unit 400. This may be performed before the imaging drum unit 400 is disassembled. Imaging drum unit 400 may be inserted and secured in a conversion jig (not shown). After the imaging drum unit 400 is secured into place, a RotoZip™ tool may be used to add the recess 485. Alternatively, a Dremmel™ tool or other type of cutting instrument may be used instead of the Rotozip tool. Once the recess 485 has been added, a file or other type of instrument may be used to smooth out any rough edges.

In another embodiment of the present invention, the key 495 (FIG. 7B) is removed from the drive side end plate 440'. This may also be performed before the imaging drum unit is disassembled. Imaging drum unit may be inserted and secured in a conversion jig (not shown). After the imaging drum unit is secured into place, a RotoZip™ tool may be used to remove the key 495. Alternatively, a Dremmel™ tool or other type of cutting instrument may be used instead of the Rotozip tool. Once the key 495 has been removed, a file or other type of instrument may be used to smooth out any rough edges where the key 495 was formally located.

In one embodiment of the present invention, the gear side end plate 430 may be replaced with a preformed replacement part that is similar to the gear side endplate 430' comprising a recess 485. In yet another embodiment, the drive side end plate 440' may be replaced with a preformed replacement part similar to the drive side end plate 440 which does not have any keying features. The replacement parts may be a gear side end plate 430 or drive side end plate 440' that has undergone the conversion process as outlined herein. Alternatively, the replacement part may be a prefabricated gear side end plate 430' with the recess 485 or a drive side end plate 440 manufactured without the keying features previously described.

Within the toner cartridge or imaging drum unit, an electronic identification chip may be installed. The identification chip may contain information relating to the printer type, printer manufacturer, amount of toner contained in the toner cartridge and so forth. Even if the physical restrictions between cartridge types have been removed, the electronic identification chip may need to be replaced in order to allow the toner cartridge or imaging drum unit to function properly in its new location or printer.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying an imaging process cartridge, the imaging process cartridge sized to be installed in a first location in a first type of color imaging device and not sized to be installed in either a second location in said first color imaging device or a second type of color imaging device, the method comprising:

providing the imaging process cartridge said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, removing said protrusion from said external surface, said imaging process cartridge now usable in either a second location within said first color imaging device or said second color imaging device.

2. The method of claim 1 wherein said protrusion is square in shape.

3. The method of claim 1 wherein said protrusion is elliptical in shape.

4. The method of claim 1 wherein said protrusion further comprises an inner wall and an outer wall.

5. The method of claim 1 wherein said imaging process cartridge further comprises a contact side end plate comprising a second external surface and a second protrusion mounted perpendicularly to said second external surface, said second protrusion extending away from said imaging process cartridge; and removing said second protrusion from said second external surface.

6. A method of modifying an imaging process cartridge, the imaging process cartridge sized to be installed in a first location in a first type of color imaging device and not sized to be installed in either a second location in said first color imaging device or a second type of color imaging device, the method comprising:

providing the imaging process cartridge, said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, separating said gear side faceplate from said imaging process cartridge, removing said protrusion from said external surface, reattaching said gear side faceplate to said imaging process cartridge, said imaging process cartridge now usable in either a second location within said first color imaging device or said second color imaging device.

7. The method of claim 6 wherein said protrusion is square in shape.

8. The method of claim 6 wherein said protrusion is elliptical in shape.

9. The method of claim 6 wherein said protrusion further comprises an inner wall and an outer wall.

10. The method of claim 6 wherein said imaging process cartridge further comprises a contact side end plate comprising a second external surface and a second protrusion mounted perpendicularly to said second external surface, said second protrusion extending away from said imaging process cartridge; and removing said second protrusion from said second external surface.

11. A method of modifying an imaging process cartridge, the imaging process cartridge sized to be installed in a first location in a first type of color imaging device and not sized to be installed in either a second location in said first color imaging device or a second type of color imaging device, the method comprising:

providing the imaging process cartridge said imaging process cartridge only operable in said color imaging device, said imaging process cartridge further comprising a gear side faceplate, said gear side face plate further comprising an external surface and a protrusion mounted perpendicularly at a first position on said external surface, said protrusion extending away from said imaging process cartridge, said first position corresponding to a color of toner stored in said imaging process cartridge; and, separating said gear side faceplate from said imaging process cartridge, attaching a new gear side faceplate to said imaging process cartridge, said new gear side faceplate not having a protrusion, said imaging process cartridge now usable in either a second location within said first color imaging device or said second color imaging device.

12. The method of claim 11 wherein said protrusion is square in shape.

13. The method of claim 11 wherein said protrusion is elliptical in shape.

14. The method of claim 11 wherein said protrusion further comprises an inner wall and an outer wall.

15. The method of claim 11 wherein said imaging process cartridge further comprises a contact side end plate comprising a second external surface and a second protrusion mounted perpendicularly to said second external surface, said second protrusion extending away from said imaging process cartridge; and, removing said second protrusion from said second external surface.

* * * * *